US005201151A

United States Patent [19]

LeBlanc et al.

[11] Patent Number: 5,201,151

[45] Date of Patent: Apr. 13, 1993

[54] MANHOLE RIM AND COVER ASSEMBLY

[75] Inventors: Leo J. LeBlanc, Bloomfield Hills; Paul Phillips, White Hall, both of Mich.

[73] Assignee: EBW, Inc., Muskegon, Mich.

[21] Appl. No.: 775,728

[22] Filed: Oct. 11, 1991

[51] Int. Cl.[5] ..... E02D 29/14

[52] U.S. Cl. ..... 52/20; 52/21; 404/25; 404/26

[58] Field of Search ..... 52/19, 20, 21; 210/163, 210/164, 166; 404/25, 26

[56] References Cited

U.S. PATENT DOCUMENTS

| | | | |
|---|---|---|---|
| 4,187,647 | 2/1980 | Hall | 52/20 |
| 4,188,151 | 2/1980 | Hall . | |
| 4,532,915 | 8/1985 | de Rham | 52/19 |
| 4,593,714 | 6/1986 | Madden . | |
| 4,662,777 | 5/1987 | Newton . | |
| 4,762,440 | 8/1988 | Argandona . | |
| 4,763,449 | 8/1988 | Vigneron et al. | 52/20 |
| 4,793,387 | 12/1988 | LeBlanc et al. . | |
| 4,896,705 | 1/1990 | Podgers et al. . | |
| 4,973,191 | 11/1990 | Dannhäuser . | |

*Primary Examiner*—David A. Scherbel
*Assistant Examiner*—Wynn E. Wood
*Attorney, Agent, or Firm*—Basile and Hanlon

[57] ABSTRACT

A manhole rim and cover assembly includes a rim formed with an annular upwardly projecting lip extending around its central opening with a shoulder projecting radially inwardly from the lip at a location spaced below its upper edge. A cover has circumferentially spaced circumferential segments projecting downwardly from its lower surface to fit within the inner side of the lip and to rest upon the shoulder referred to above to prevent crushing of a sealing gasket received between the bottom of the cover and the upper edge of the lip. Vent openings are formed through the lip to vent the manhole when the cover is in place. Spring clips on the cover engage an undercut shoulder on the rim to releasably retain the cover against removal from the rim.

14 Claims, 1 Drawing Sheet

MANHOLE RIM AND COVER ASSEMBLY

BACKGROUND OF THE INVENTION

The present invention is directed to a manhole rim and cover assembly which, while useful in other applications, is particularly well-adapted for use in manholes utilized in gasoline service stations to provide access to underground storage tank fill pipes.

In the past, fill pipe manholes for underground gasoline storage tanks consisted simply of concrete or steel sidewalls closed at their upper end by a cover with the bottom of the manhole being soil. Gasoline spilled into the manhole when the supply hose from the tank truck was uncoupled from the fill pipe simply drained into the ground. Present-day environmental concerns find most fill pipe manholes now incorporating an overfill storage container such as that disclosed U.S. Pat. No. 4,793,387. Such containers typically consist simply of a bucket-like reservoir mounted on the fill pipe below its upper end to capture fuel which might be spilled when the supply hose is uncoupled. A drain valve is usually provided to drain captured fuel from the vessel back into the fill pipe when the level of fuel drops sufficiently.

It is believed apparent that in such a spill containment device application, the manhole cover should be sealed sufficiently tightly to the rim so that water cannot leak into the reservoir to be subsequently drained into the storage tank along with overfill fuel. However, if a water-tight seal between cover and rim is employed, temperature variations under some circumstances can produce a partial vacuum within the reservoir which will make removal of the cover extremely difficult.

Insofar as retaining the cover in position upon the manhole rim, the prior art typically either simply relies upon gravity to hold the cover in position or alternatively utilizes bolts. Reliance on gravity alone is sometimes insufficient, while the utilization of bolts requires that the bolts be removed to release the cover and replaced to reseal it. In order to replace the bolts, it is necessary to precisely align the bolt holes the cover with the bolt hole receiving bores in the rim.

The present invention is directed to a manhole cover and rim assembly which addresses the problems referred to above.

SUMMARY OF THE INVENTION

The present invention includes a rim which is suitably anchored in the concrete apron of a service station and formed with a central opening which constitutes the upper end opening of the manhole. The rim is formed with an integral upwardly projecting lip extending around the periphery of the central opening, and an inwardly projecting upwardly facing shoulder is formed on the rim to project inwardly from the lip at a location spaced downwardly from the upper edge of the lip. An undercut recess in the outer side surface of the lip provides a downwardly facing shoulder into which spring clips located at spaced locations around the periphery of the manhole cover can project to releasably retain the cover in a closed position upon the rim.

The cover, which preferably is formed from fiberglass, if formed with integral downwardly projecting arcuate locating segments which extend circumferentially of the cover in circumferentially spaced relationship with each other. The lower edges of the locating segments are adapted to rest upon the upwardly facing shoulder of the rim with the outwardly facing side surfaces of the locating segments in opposed face-to-face relationship with the inner side surfaces of the lip upon the rim. When seated upon the upwardly facing shoulder of the rim, the locating segments support the underside of the cover at a fixed location above the lip such that a gasket engaged between the upper edge of the lip on the rim and the underside of the cover is compressed sufficiently to form a water-tight seal. The locating segments prevent the cover from being depressed, as when a gasoline delivery truck might drive over the manhole, sufficiently to permanently crush or injure the gasket.

One or more of vent openings in the form of bores extending through the lip along axes inclined upwardly and inwardly of the rim, are located at spaced locations around the circumference of the lip such that when the cover is in place at least some of the vent openings will open at locations not blocked by the locating segments. The upwardly inclination of the vent openings prevents water from draining into the interior of the manhole, and preferably, the vent openings are plugged or otherwise filled by any of several commercially available materials which will pass air, but not water.

Other objects and features of the invention will become apparent by reference to the following specification and to the drawings.

In the Drawings

Figure 2:
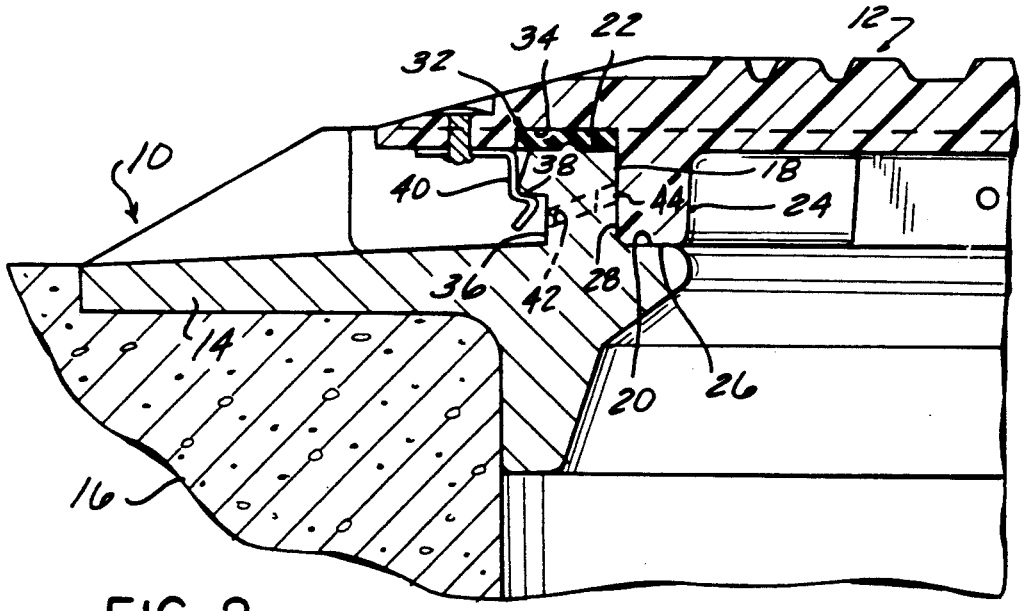
FIG. 2 is a cross-sectional view of the assembly of FIG. 1 taken on line 2—2 of FIG. 1.
Figure 3:
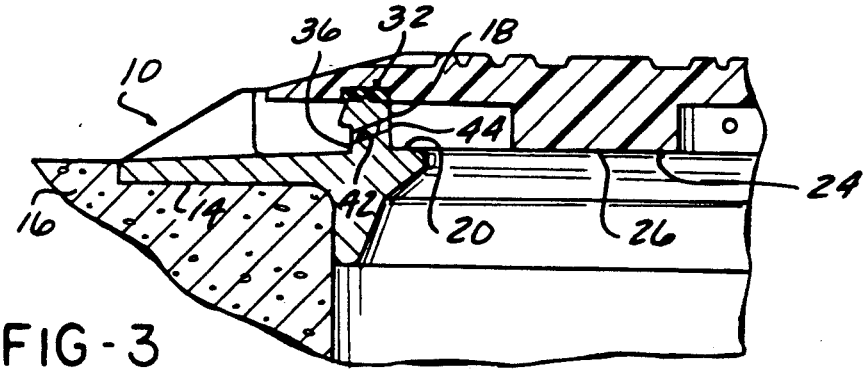
FIG. 3 is a detailed cross-sectional view taken approximately on line 3—3 of FIG. 2.

Typically, the rim and cover, designated 10 and 12 respectively, of the present invention are of circular configuration when viewed in plan, and hence structural details of rim 10 and cover 12 are perhaps best apparent from the cross-sectional view of FIG. 2 of the drawings.

Figure 1:
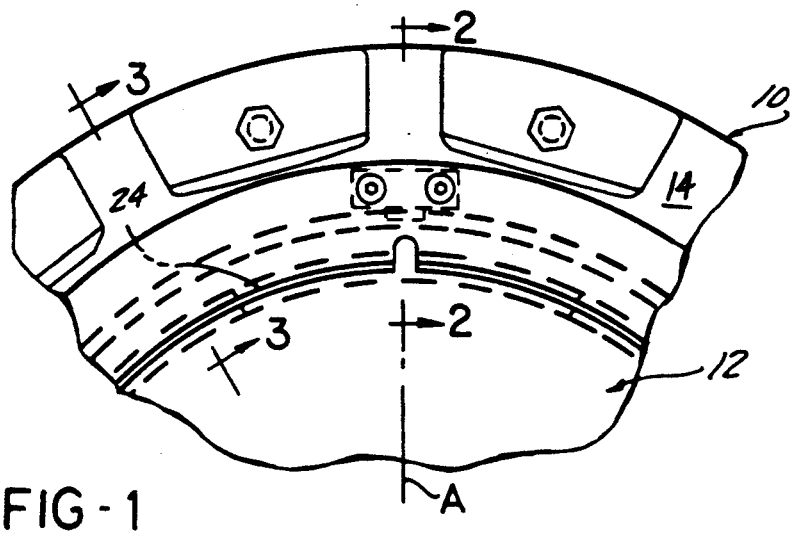
FIG. 1 is a top plan view of a segment of a manhole rim and cover assembly embodying the present invention.

Rim 10 includes a main body portion 14 which, as shown in FIG. 2, is seated upon a concrete base 16, which may be a portion of a service station apron. Rim 14 is fixedly anchored to the concrete as by anchoring means of conventional construction designated generally 16 (FIG. 1). In the form of the invention shown in the drawings, the concrete base 16 extends vertically downwardly from rim 10 as at 18 to define the sidewall of a manhole. In other manhole configurations, the manhole sides may be formed by metal or plastic tubing fixedly secured at its upper end to rim 10.

Rim 10 is formed with an integral upwardly projecting annular lip 18 which extends continuously around the circumference of the central opening through the annular rim 18. A radially inwardly projecting upwardly facing shoulder 20 is integrally formed on rim 10 with the upwardly facing shoulder 20 being spaced below the upper edge 22 (FIG. 2) of lip 18.

Cover 12, which preferably is formed of fiberglass, is formed with downwardly projecting arcuate locating segments 24 which lie at constant radial distance from the axis A of the cover, the individual segments 24 extending circumferentially of axis A and being circumferentially spaced from each other. The segments 24 are formed with flat lower edges 26 and substantially cylindrical outer side surfaces 28 which are so dimensioned as to be received within the inner side surface 30 of lip 18. The surfaces 28 and 30 are dimensioned to have a loose fit with each other which is tight enough to prevent any substantial horizontal displacement of cover 12 relative to rim 10 when the cover is in the closed position shown in FIG. 2, while being loose enough to accommodate relatively unrestricted vertical movement of cover 12 relative to rim 10 as the cover is moved to and from its closed position.

An annular sealing gasket 32 is received within an annular recess 34 in the bottom of cover 12 just outwardly of locating segments 24 to overlie upper surface 22 of lip 18 on rim 10. The vertical dimension of the locating segments 24 on cover 12 is such that when the bottom edges 28 of locating segments 24 on the cover 12 rest upon the upwardly facing shoulder 20 of rim 10, gasket 32 is compressed between the cover 12 and surface 22 of lip 18 by an amount sufficient to establish a continuous water-tight seal between the cover 12 and the top of lip 18. However, the engagement between the locating segments 24 and shoulder 20 positively prevents the cover from being pressed downwardly any further. This fact is of importance in that automobiles and even loaded fuel delivery trucks may drive over the cover 12 when it is in the closed position shown in FIG. 2 and this substantial weight, in the absence of the support of the cover 12 upon shoulder 20, could compress gasket 32 to the point of failure.

To retain cover 12 in position upon rim 10, an undercut recess 36 is formed in the outer side of lip 18 to extend entirely around the outer circumference of the lip 18. Recess 36 provides an undercut or downwardly facing shoulder 38, and a plurality of spring clips 40 are mounted at circumferentially spaced locations about the periphery of cover 12 on the underside of the cover 12 to be resiliently seated beneath shoulders 38 when the cover 12 is in the closed position of FIG. 2. Clips 40 have sufficient resiliency so that elevation of cover 12, as by a pry-bar, will release the clip 40 from engagement with the shoulder 38.

When gasket 32 is compressed to provide a water-tight seal between the cover and rim, it also provides a substantially air-tight seal. Under certain conditions, ambient temperature variations can induce a partial vacuum in the manifold beneath the cover 12 which, due to the effective area of the cover 12, will exert a substantial force resisting opening of the cover 12. To overcome this problem, a plurality of vent openings 42 are formed to extend through lip 18 along respective axes which are inclined upwardly and inwardly toward the central axis A. The vent openings 42 are located at circumferential spacings from each other which are smaller than the circumferential spacing between adjacent locating segments 24 so that regardless of the rotative orientation of cover 12 relative to rim 10, at least some of these vent openings 42 will open at the inner side of lip 18 within spaces between adjacent locating segments 24. The inclination of the vent openings discourages the flow of water inwardly through lip 18, and to assure that water will not flow into the manhole through the vent openings 42, the openings are plugged with a material 44 which will pass air, but not pass water—i.e., a material which might be said to effectively filter the water droplets from moist air. Several materials possessing this capability are commercially available and well-known to those skilled in the art.

While one embodiment of the invention has been described in detail, it will be apparent to those skilled in the art the disclosed embodiment may be modified. Therefor, the foregoing description is to be considered exemplary rather than limiting, and the true scope of the invention is that provided in the following claims.

What is claimed is:

1. A manhole cover comprising an annular rim member having a central opening and adapted to be fixedly mounted at ground level with said central opening defining the entrance opening at the upper end of a manhole, said rim member having an integral annular lip projecting upwardly from the upper surface of said rim member and extending continuously around the periphery of said central opening, said lip having a generally vertical inner side surface defining the periphery of said central opening, a generally flat gasket receiving surface constituting the upper surface of said lip, and an outer side surface having a continuous undercut annular recess therein defining a downwardly facing annular shoulder, an annular sealing gasket located on said upper surface of said lip, a cover member adapted to overlie said central opening and to project outwardly from said opening beyond said outer side surface of said lip, locating means projecting downwardly from said lower surface of said cover into face-to-face engagement with said inner side surface of said lip to maintain said cover against horizontal displacement relative to said rim, an annular gasket sealingly engaged between the under side of said cover and said upper surface of said lip, and a plurality of spring clip means mounted on said lower surface of said cover at spaced locations about the periphery of said cover, said spring clip means projecting downwardly from said cover into underlying relationship with said downwardly facing annular shoulder on said lip to releasably retain said cover against vertical movement relative to said rim.

2. The invention defined in claim 1 wherein said locating means further comprises a lower edge surface and said rim comprises means defining an upwardly facing shoulder on said rim projecting inwardly of said rim from said inner side surface to engage the lower sides of said locating means and support said cover upon said rim at an elevation such that said gasket is compressed to form a water-tight seal between said cover and said upper surface of said lip.

3. The invention defined in claim 1 further comprising means for venting the interior of said cover.

4. The invention defined in claim 2 wherein said upwardly facing shoulder on said rim extends around the periphery of said opening, said locating means comprising a plurality of locating segments circumferentially spaced from each other, and means comprising a vent passage extending through said lip from said outer side surface to open through the inner side surface of said lip into the space between a selected pair of said locating segments.

5. The invention defined in claim 4 further comprising a plurality of said vent passages extending through said lip from said outer side surface to open through said inner side surface of said lip into the spaces between said locating segments.

6. The invention defined in claim 4 further comprising moisture seal means in said vent passages comprising a material operable to pass air while functioning as a moisture barrier.

7. The invention defined in claim 6 wherein said vent passages are defined by a plurality of bores extending through said lip along respective axes which are inclined upwardly and inwardly of said lip.

8. A manhole cover comprising:

rim means defining a central opening for fixed mounting generally at ground level, said rim means having a lip projecting upwardly from an upper surface of said rim means and extending around a periphery of said central opening, said lip having a generally flat gasket receiving upper surface, and an outer side surface having an undercut recess therein defining a downwardly facing shoulder;

cover means for overlying said central opening, said cover means projecting outwardly from said central opening beyond said outer side surface of said lip;

locating means for maintaining said cover means against horizontal displacement relative to said rim means, said locating means projecting downwardly from a lower surface of said cover means into face-to-face engagement with an inner side surface of said lip;

gasket means for sealingly engaging between said lower surface of said cover means and said flat gasket receiving upper surface of said lip; and means for releasably retaining said cover means against vertical movement relative to said rim means, said retaining means projecting downwardly into underlying relationship with said downwardly facing shoulder on said lip.

9. The manhole cover of claim 8 further comprising:

said locating means including a lower edge surface; and shoulder means facing upwardly and projecting inwardly of said rim means from said inner side surface for engaging the lower edge surface of said locating means and for supporting said cover means on said rim means at an elevation such that said gasket means is compressed to form a watertight seal between said cover means and said upper surface of said lip.

10. The manhole cover of claim 9 further comprising:

said rim means and said cover means defining at least a portion of an enclosed underground chamber; and vent means for venting said enclosed underground chamber through said rim means to atmosphere.

11. The manhole cover of claim 10 further comprising:

said shoulder means extending around the periphery of said central opening;

said locating means including a plurality of locating segments circumferentially spaced from each other; and said vent means including at least one vent passage extending through said lip from said outer side surface to open through said inner side surface of said lip into a space between at least one selected pair of said locating segments.

12. The manhole cover of claim 11 further comprising:

moisture seal means disposed in said at least one vent passage for operably allowing passage of air while functioning as a moisture barrier to prevent ingress of moisture into said enclosed underground chamber.

13. The manhole cover of claim 12 further comprising:

said at least one vent passage including a plurality of bores extending along respective axes inclined upwardly and inwardly through said lip toward said central opening.

14. A manhole cover comprising:

rim means defining a central opening for fixed mounting generally at ground level, said rim means having a lip projecting upwardly from an upper surface of said rim means and extending around a periphery of said central opening, said lip having a generally flat gasket receiving upper surface, and an outer side surface having an undercut recess therein defining a downwardly facing shoulder;

cover means for overlying said central opening, said cover means projecting outwardly from said central opening beyond said outer side surface of said lip, said rim means and said cover means defining at least a portion of an enclosed underground chamber;

locating means for maintaining said cover means against horizontal displacement relative to said rim means, said locating means projecting downwardly from a lower surface of said cover means into face-to-face engagement with an inner side surface of said lip, said locating means including a lower edge surface and a plurality of locating segments circumferentially spaced from each other;

gasket means for sealingly engaging between said lower surface of said cover means and said flat gasket receiving upper surface of said lip;

shoulder means facing upwardly and projecting inwardly of said rim means from said inner side surface for engaging the lower edge surface of said locating means and for supporting said cover means on said rim means at an elevation such that said gasket means is compressed to form a watertight seal between said cover means and said upper surface of said lip, said shoulder means extending around the periphery of said central opening;

retainer means for releasably retaining said cover means against vertical movement relative to said rim means, said retainer means projecting downwardly into underlying relationship with said downwardly facing shoulder on said lip;

vent means for venting said enclosed underground chamber through said rim means to atmosphere, said vent means including a plurality of vent passages extending through said lip from said outer side surface to open through said inner side surface of said lip into a space between selected pairs of said locating segments, said vent passages including a plurality of bores extending along respective axes inclined upwardly and inwardly through said lip toward said central opening; and moisture seal means disposed in said vent means for operably allowing passage of air while functioning as a moisture barrier to prevent ingress of moisture into said enclosed underground chamber.

* * * * *

UNITED STATES PATENT AND TRADEMARK OFFICE

CERTIFICATE OF CORRECTION

PATENT NO. : 5,201,151

DATED : April 13, 1993

INVENTOR(S) : Leo J. LeBlanc, P. Phillips

It is certified that error appears in the above-identified patent and that said Letters Patent is hereby corrected as shown below:

Column 2, line 47, please delete "14" and insert --10--.

Column 2, line 47, after "concrete" please insert --16--.

Column 2, line 49, please delete "1" and insert --2--.

Column 2, line 58, please delete "annular".

Column 2, line 58, please delete "18" and insert --10--.

Column 2, line 65, after "cover" please insert --12--.

Column 2, line 68, please delete "edges" and insert --surfaces--.

Column 3, line 6, after "cover" please insert --12--.

Column 3, line 9, after "cover" please insert --12--.

Column 3, line 23, after "cover" please insert --12--.

Column 3, line 44, after "cover" please insert --12--.

Column 3, line 44, after "rim" please insert --10--.

Column 3, line 60, after "openings" please insert --42--.

Column 3, line 63, after "openings" please insert --42--.

UNITED STATES PATENT AND TRADEMARK OFFICE

CERTIFICATE OF CORRECTION

PATENT NO. : 5,201,151

DATED : April 13, 1993

INVENTOR(S) : Leo J. LeBlanc, P. Phillips

It is certified that error appears in the above-indentified patent and that said Letters Patent is hereby corrected as shown below:

Column 3, line 63, after "openings" please insert --42--.

Signed and Sealed this

Eighth Day of March, 1994

Bruce Lehman

*Attest:*

BRUCE LEHMAN

*Attesting Officer*

*Commissioner of Patents and Trademarks*